US011964843B2

(12) United States Patent
Mori et al.

(10) Patent No.: US 11,964,843 B2
(45) Date of Patent: Apr. 23, 2024

(54) TRANSPORT DEVICE AND IMAGE FORMING APPARATUS

(71) Applicant: FUJIFILM Business Innovation Corp., Tokyo (JP)

(72) Inventors: Takuya Mori, Kanagawa (JP); Yuya Chonabayashi, Kanagawa (JP); Tomoya Kosuge, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 343 days.

(21) Appl. No.: 17/369,361

(22) Filed: Jul. 7, 2021

(65) Prior Publication Data

US 2022/0306412 A1 Sep. 29, 2022

(30) Foreign Application Priority Data

Mar. 29, 2021 (JP) ..... 2021-055143

(51) Int. Cl.
*B65H 5/36* (2006.01)

(52) U.S. Cl.
CPC ..... *B65H 5/36* (2013.01); *B65H 2402/441* (2013.01)

(58) Field of Classification Search
CPC . B65H 5/36; B65H 2402/441; B65H 2402/45
See application file for complete search history.

(56) References Cited

U.S. PATENT DOCUMENTS

| | | | | |
|---|---|---|---|---|
| 8,442,418 | B2 | 5/2013 | Koga et al. | |
| 8,636,283 | B2 * | 1/2014 | Akiyama | B65H 3/34 271/264 |
| 8,820,740 | B2 * | 9/2014 | Sugizaki | B65H 5/00 271/264 |
| 10,472,192 | B2 * | 11/2019 | Mizuta | B65H 5/38 |
| 2005/0196216 | A1 * | 9/2005 | Tanahashi | B65H 5/38 400/625 |
| 2016/0368726 | A1 * | 12/2016 | Hayakawa | B65H 29/60 |
| 2021/0032055 | A1 * | 2/2021 | Uehara | G03G 15/6529 |
| 2022/0063940 | A1 * | 3/2022 | Ogasawara | B65H 3/66 |
| 2022/0144570 | A1 * | 5/2022 | Ishibe | B65H 7/14 |
| 2022/0194084 | A1 * | 6/2022 | Nakahata | B41J 29/13 |

FOREIGN PATENT DOCUMENTS

| | | |
|---|---|---|
| JP | 2006-251159 A | 9/2006 |
| JP | 2011-13299 A | 1/2011 |

* cited by examiner

*Primary Examiner* — Patrick Cicchino
(74) *Attorney, Agent, or Firm* — Oliff PLC

(57) ABSTRACT

A transport device includes a transport member that transports a recording medium while adjusting a leading end of the recording medium, and a guide member that is disposed upstream from the transport member in a transport direction of the transport member to guide the recording medium to the transport member along a transport path, the guide member being rotatable in a direction to open the transport path while having a downstream portion in the transport direction of the transport member serving as an axis.

18 Claims, 11 Drawing Sheets

TRANSPORT DEVICE AND IMAGE FORMING APPARATUS

CROSS-REFERENCE TO RELATED APPLICATIONS

This application is based on and claims priority under 35 USC 119 from Japanese Patent Application No. 2021-055143 filed Mar. 29, 2021.

BACKGROUND

(i) Technical Field

The present disclosure relates to a transport device and an image forming apparatus.

(ii) Related Art

Examples of a technology relating to an image forming apparatus including a transport device have been described in Japanese Unexamined Patent Application Publication No. 2011-013299 or Japanese Unexamined Patent Application Publication No. 2006-251159.

Japanese Unexamined Patent Application Publication No. 2011-013299 describes a structure that includes a transport unit for transporting sheets, a first door capable of opening the transport unit, a rotation shaft rotatably supporting the first door, and a second door openable or closeable with respect to the first door. The second door is capable of opening the transport unit near the rotation shaft.

Japanese Unexamined Patent Application Publication No. 2006-251159 describes a structure where a first guide member and a confluence guide member form a first sheet transport path, a second guide member and the confluence guide member form a second sheet transport path, the first guide member and the second guide member form a confluence portion where the first sheet transport path and the second sheet transport path merge, the first guide member is openably and closeably supported by a housing body in a manner interlocked with an open-close member, and the confluence guide member is independently supported to be openable and closeable with respect to the housing body.

SUMMARY

Aspects of non-limiting embodiments of the present disclosure relate to a structure where a guide member that guides a recording medium to a transport member downstream from the guide member in a direction of transporting the recording medium is further prevented from being interfered with the transport member when the guide member is rotated in a direction to open a transport path, than in a case where a rotation axis of the guide member is disposed on an upstream side in the direction of transporting the recording medium.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a transport device including a transport member that transports a recording medium while adjusting a leading end of the recording medium, and a guide member that is disposed upstream from the transport member in a transport direction of the transport member to guide the recording medium to the transport member along a transport path, the guide member being rotatable in a direction to open the transport path while having a downstream portion in the transport direction of the transport member serving as an axis.

BRIEF DESCRIPTION OF THE DRAWINGS

Exemplary embodiments of the present disclosure will be described in detail based on the following figures, wherein.

DETAILED DESCRIPTION

Embodiments of the present disclosure will be described below with reference to the drawings.

First Exemplary Embodiment

Figure 1:
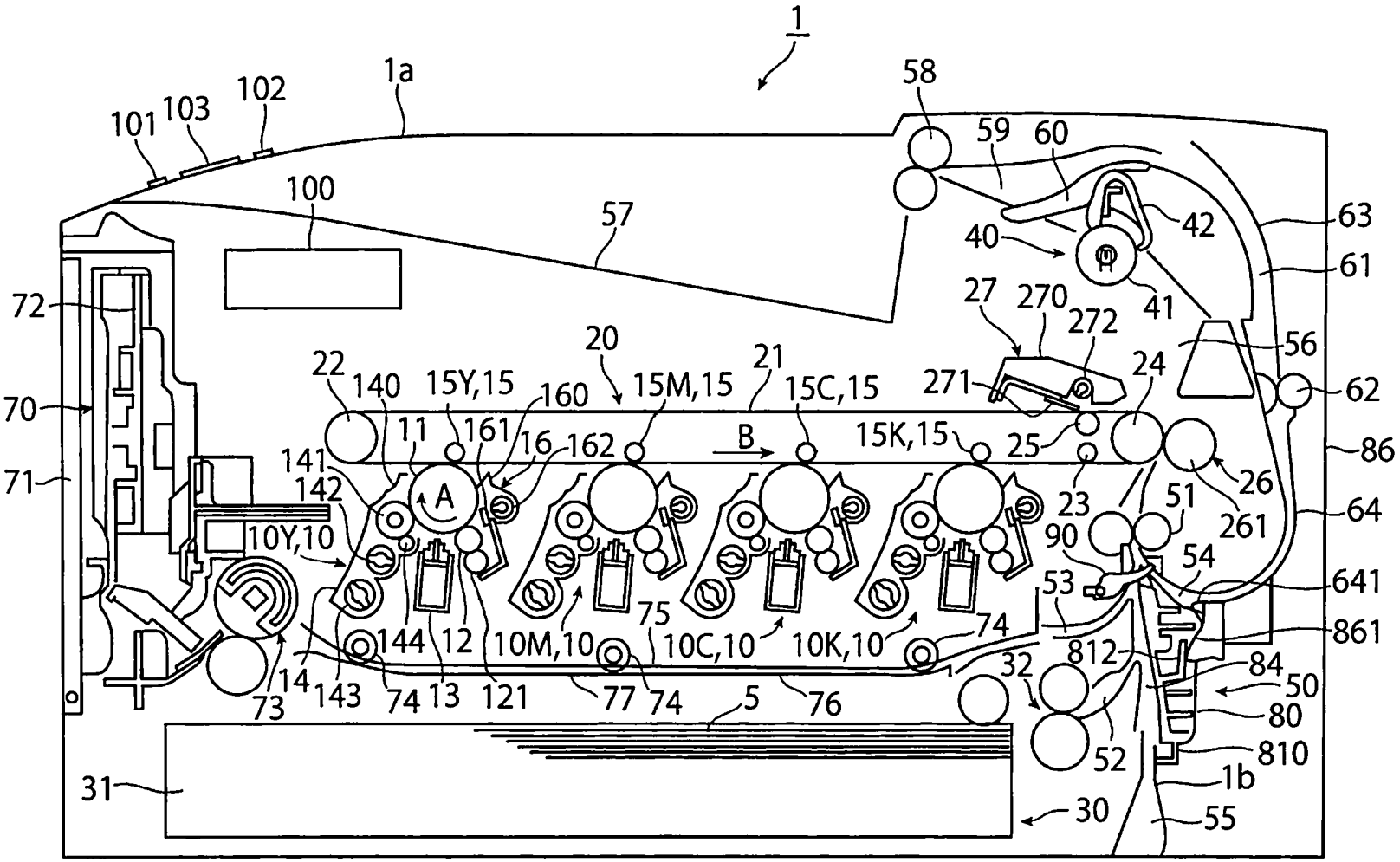
FIG. 1 is a schematic diagram of a structure of an image forming apparatus in which a transport device according to a first exemplary embodiment of the present disclosure is included.

FIG. 1 is a structure diagram roughly showing the entirety of an image forming apparatus in which a transport device according to a first exemplary embodiment of the present disclosure is included.

<Entire Structure of Image Forming Apparatus>

An image forming apparatus 1 according to a first exemplary embodiment is, for example, a color printer. The image forming apparatus 1 is capable of forming full-color images on A4-size recording media, and has a size far smaller than existing apparatuses. The image forming apparatus 1 includes multiple image forming devices 10 that form toner images through development with toner serving as a developer, an intermediate transfer device 20 that holds toner images formed by the image forming devices 10 and transports the toner images to a second transfer position where the toner images are finally second-transferred to recording sheets 5 serving as recording media, a sheet feeder 30 that accommodates the predetermined recording sheets 5 to be fed to the second transfer position of the intermediate transfer device 20 and feeds the recording sheets 5 to the second transfer position, and a fixing device 40 that fixes toner images on each recording sheet 5 second-transferred by the intermediate transfer device 20 to the recording sheet 5. An apparatus body 1*a* of the image forming apparatus 1 includes an outer cover or a support structure member formed from, for example, sheet metal. In the present exemplary embodiment, the multiple image forming devices 10 and the intermediate transfer device 20 form an image forming member.

The image forming apparatus 1 has a size far smaller than existing apparatuses, as described above. The apparatus body 1*a* of the image forming apparatus 1 has far smaller height, depth, and width than an existing full-color image forming apparatus capable of handling A4-size recording sheets 5 to have a size about the same as an existing monochrome image forming apparatus.

The image forming apparatus 1 includes the multiple image forming devices 10, the intermediate transfer device 20, and the sheet feeder 30. To reduce the size of the apparatus body 1*a* of the image forming apparatus 1, the multiple image forming devices 10, the intermediate transfer device 20, and the sheet feeder 30 also need to reduce their height, depth, and width.

The image forming devices 10 include four image forming devices 10Y, 10M, 10C, and 10K that respectively form toner images of yellow (Y), magenta (M), cyan (C), and black (K). These four image forming devices 10 (10Y, 10M, 10C, and 10K) are arranged in a line in a horizontal direction in a space inside the apparatus body 1*a*.

As shown in FIG. 1, each of the image forming devices 10 (10Y, 10M, 10C, and 10K) includes a rotatable photoconductor drum 11 serving as an image carrier. Around the photoconductor drum 11, the following devices are disposed as examples forming a toner image forming member. The devices include a charging device 12 that charges the periphery (image holding surface) of the photoconductor drum 11 that allows images to be formed thereon with a predetermined potential, an exposing device 13 that forms electrostatic latent images (for different colors) with a potential difference by irradiating the charged periphery of the photoconductor drum 11 with light based on image information (signal), developing devices 14 (for the colors of Y, M, C, and K) that develop the electrostatic latent images with developer toner of the corresponding colors (Y, M, C, and K) into toner images, first transfer devices 15 (15Y, 15M, 15C, and 15K) that transfer the toner images to the intermediate transfer device 20, and drum cleaners 16 (for the colors of Y, M, C, and K) that remove accretions such as toner remaining on and adhering to the image holding surface of the photoconductor drum 11 after a first transfer to clean the image holding surface.

The photoconductor drum 11 has an image holding surface including a hollow or solid cylindrical base grounded, and a photoconductor layer formed from a photoconductive material and disposed on the periphery of the base. The photoconductor drum 11 receives power from a driving device, not illustrated, and is supported to rotate in a direction indicated with arrow A.

The charging device 12 is formed from a contact charging roller disposed while being in contact with the photoconductor drum 11. The charging device 12 includes a cleaning roller 121 that cleans the surface of the photoconductor drum 11. The charging device 12 receives a charging voltage. For the developing device 14 that performs reversal development, a voltage or current with a polarity the same as the polarity with which toner fed from the developing device 14 is charged is used as an example of a charging voltage.

A light emitting diode (LED) print head that forms electrostatic latent images with LEDs irradiating the photoconductor drum 11 with light corresponding to image information is used as an example of the exposing device 13. The LEDs serve as multiple light emitting devices arranged in the axial direction of the photoconductor drum 11.

As illustrated in FIG. 1, each of the developing devices 14 (for the colors of Y, M, C, and K) includes a housing 140 having an opening and a developer holding chamber, and, inside the housing 140, a development roller 141 that holds and transports the developer to a development area facing the photoconductor drum 11, two agitation transport members 142 and 143 such as screw augers that transport the developer beside the development roller 141 while agitating the developer, and a layer thickness restrictor 144 that restricts the amount (layer thickness) of the developer held on the development roller 141. A development voltage is supplied from a power source, not illustrated, across the development roller 141 of the developing device 14 and the photoconductor drum 11. The development roller 141 and the agitation transport members 142 and 143 receive power from a driving device, not illustrated, and rotate in a predetermined direction. A binary developer containing nonmagnetic toner and a magnetic carrier is used as an example of developers of the four colors Y, M, C, and K. The developing device 14 receives a developer containing toner of at least a corresponding color from a toner cartridge disposed at one of the ends of the agitation transport member 143 in the axial direction. The toner cartridge is not illustrated.

The first transfer devices 15 (15Y, 15M, 15C, and 15K) are contact transfer devices each including a first transfer roller that comes into contact with the periphery of the photoconductor drum 11 with an intermediate transfer belt 21 interposed therebetween to rotate, and receives a first transfer voltage. A direct-current voltage with a polarity opposite to the polarity with which toner is charged is supplied from a power source, not illustrated, to serve as the first transfer voltage.

As illustrated in FIG. 1, each drum cleaner 16 includes a body 160 with a container shape that opens partially, a cleaning plate 161 that is disposed while being pressed with a predetermined pressure against the periphery of the photoconductor drum 11 after undergoing a first transfer to remove accretions such as remaining toner to clean the photoconductor drum 11, and a delivery member 162 such as a screw auger that collects accretions such as toner removed by the cleaning plate 161 and transports the accretions to a recovery system, not illustrated. Examples usable as the cleaning plate 161 includes a plate-shaped member (such as a blade) formed from a material such as rubber. Accretions such as toner transported by the delivery member 162 of the cleaner 16 are collected into a first toner recovery bottle, not illustrated, disposed at a first end of the delivery member 162 in the axial direction. The first toner recovery bottle is disposed at the end on the same side as the side on which the toner cartridge is disposed.

As illustrated in FIG. 1, the intermediate transfer device 20 is disposed above the image forming devices 10 (10Y, 10M, 10C, and 10K). The intermediate transfer device 20 includes an intermediate transfer belt 21 that rotates in a direction of arrow B while passing by first transfer positions between the photoconductor drum 11 and the first transfer devices 15 (first transfer rollers), multiple belt support rollers 22 to 25 that hold and rotatably support the intermediate transfer belt 21 on the inner surface of the intermediate transfer belt 21 in an intended state, a second transfer device 26 disposed to face the outer periphery (image holding surface) of the intermediate transfer belt 21 supported by the belt support roller 24 to second-transfer the toner images on the intermediate transfer belt 21 to the recording sheet 5, and a belt cleaner 27 that removes accretions such as toner or paper dust remaining on and adhering to the outer periphery of the intermediate transfer belt 21 that has passed by the second transfer device 26 to clean the intermediate transfer belt 21. The intermediate transfer belt 21 is stretched by the belt support roller 22 and the belt support roller 24 with relatively large outer diameters to form movement paths substantially parallel to each other.

An endless belt formed from a material obtained by dispersing a resistance regulator such as carbon black in synthetic resin such as polyimide resin or polyamide resin is used as an example of the intermediate transfer belt 21. The belt support roller 22 serves as a stretching roller that exerts tension on the intermediate transfer belt 21. The belt support roller 23 serves as a face-out roller that forms an image forming surface of the intermediate transfer belt 21. The belt support roller 24 serves as a driving roller that is driven to rotate by a driving device, not illustrated, and also serves as a rear-surface support roller during a second transfer. The belt support roller 25 serves as an opposing roller that opposes a cleaning plate 271 of the belt cleaner 27.

As illustrated in FIG. 1, the second transfer device 26 is a contact transfer device that includes a second transfer roller 261 that receives a second transfer voltage and rotates while being in contact with the periphery of the intermediate transfer belt 21 in the second transfer position, which is an outer peripheral portion of the intermediate transfer belt 21 supported by the belt support roller 24 in the intermediate transfer device 20. The second transfer roller 261 or the belt support roller 24 of the intermediate transfer device 20 receives, as a second transfer voltage, a direct-current voltage with a polarity opposite to or the same as the polarity with which toner is charged from the power source not illustrated.

The belt cleaner 27 includes a body 270 with a container shape that opens partially, a cleaning plate 271 that is disposed while being pressed with a predetermined pressure against the periphery of the intermediate transfer belt 21 after undergoing a second transfer to remove accretions such as remaining toner to clean the intermediate transfer belt 21, and a delivery member 272 such as a screw auger that collects accretions such as toner removed by the cleaning plate 271 and transports the accretions to a recovery system, not illustrated. Examples usable as the cleaning plate 271 include a plate-shaped member (such as a blade) formed from a material such as rubber. Accretions such as toner transported by the delivery member 272 of the belt cleaner 27 are collected into a second toner recovery bottle not illustrated disposed at a first end of the delivery member 272 in the axial direction. The second toner recovery bottle is disposed at the end on the same side as the side on which the toner cartridge and the first toner recovery bottle are disposed.

The fixing device 40 includes a roller-shaped or belt-shaped heating rotator 41 and a belt-shaped or roller-shaped pressing rotator 42, inside a housing, not illustrated, having an inlet port and an outlet port for the recording sheet 5. The heating rotator 41 rotates in the direction of arrow, and is heated by a heater to keep the surface temperature at a predetermined temperature. The pressing rotator 42 is driven to rotate while being pressed with a predetermined pressure against the heating rotator 41 while substantially following the contour of the heating rotator 41 in the axial direction. In the fixing device 40, a contact portion where the heating rotator 41 and the pressing rotator 42 are in contact with each other serves as a fixing processing portion that performs predetermined fixing processing (heating and pressing).

The sheet feeder 30 is disposed below the image forming devices 10 (10Y, 10M, 10C, and 10K) in the vertical direction. The sheet feeder 30 includes a single (or more) sheet container 31 that accommodates a stack of recording sheets 5 of an intended size and type, and a feeding device 32 that separately feeds the recording sheets 5 one by one from the sheet container 31. The sheet container 31 is attached to be drawable from, for example, the front surface of the apparatus body 1*a*, that is, the front surface (the left surface in FIG. 1 in the exemplary embodiment) that a user faces during the operation.

Examples usable as the recording sheets 5 include thin sheets such as ordinary sheets and tracing paper sheets, and OHP sheets used in, for example, an electrophotographic photocopier or a printer. To further improve the smoothness of the image surface after fixed, the surface of the recording sheet 5 is preferably as smooth as possible, and thus thick paper sheets with a large basis weight such as a coated paper sheet obtained by coating the surface of an ordinary sheet with a material such as resin or an art paper sheet for printing may be preferably used.

A transport device 50 that transports the recording sheets 5 fed from the sheet feeder 30 to the second transfer position is disposed between the sheet feeder 30 and the second transfer device 26. Besides the recording sheets 5 fed from the sheet feeder 30, as will be described later, the transport device 50 transports, to the second transfer position, recording sheets 5 fed from a manual sheet feeder 70, recording sheets 5 transported through a double-side-printing transport path 61 while having an image formed on one surface and being turned upside down, or recording sheet 5 fed from an auxiliary sheet feeder, not illustrated, disposed as an optional device at a lower portion of the apparatus body 1*a* of the image forming apparatus 1.

The transport device 50 includes multiple sheet-feeding transport paths including one or more pairs of sheet transport rollers 51 and multiple transport guides. As described above, the multiple sheet-feeding transport paths include, in accordance with feeders that feed the recording sheets 5 including the sheet feeder 30, a first sheet-feeding transport path 52 along which recording sheets 5 fed from the sheet feeder 30 are transported, a second sheet-feeding transport path 53 along which recording sheets 5 fed from the manual sheet feeder 70 described later are transported, a third sheet-feeding transport path 54 along which recording sheets 5 turned upside down by passing through the double-side-printing transport path 61 are transported, and a fourth sheet-feeding transport path 55 along which recording sheets 5 fed from an auxiliary sheet feeder, not illustrated, are transported. Part of each of the first to fourth sheet-feeding transport paths 52 to 55 forms a common transport path. The transport device 50 will be described in detail, later.

In the first to fourth sheet-feeding transport paths 52 to 55, the pair of sheet transport rollers 51 serving as an example of a transport member disposed immediately in front of the second transfer position are rollers (registration rollers) that adjust timing at which the recording sheets 5 are transported. A sheet transport path 56 is disposed between the second transfer device 26 and the fixing device 40. The sheet transport path 56 allows the recording sheets 5 subjected to second transfer and fed from the second transfer device 26 to be transported to the fixing device 40. A discharge transport path 59 including a pair of sheet-discharging rollers 58 to allow the recording sheet 5 subjected to a fixing operation and fed from the fixing device 40 to be discharged to a discharged-sheet receiver 57 at an upper portion of the apparatus body 1*a* is disposed near an outlet port for the recording sheet 5 formed in the apparatus body 1*a* of the image forming apparatus 1.

A switch gate 60 that switches the sheet transport paths from one to another is disposed between the fixing device 40 and the pair of sheet-discharging rollers 58. The rotation direction of the pair of sheet-discharging rollers 58 is switchable between a forward direction (discharging direction) and a reverse direction. To form images on both surfaces of the recording sheet 5, after the trailing end of the recording sheet 5 having an image formed on one surface passes the switch gate 60, the rotation direction of the pair of sheet-discharging rollers 58 is switched from the forward direction (discharging direction) to the reverse direction. When the switch gate 60 switches the transport path, the recording sheet 5 transported by the pair of sheet-discharging rollers 58 in the reverse direction is transported to the double-side-printing transport path 61 extending in substantially the vertical direction along the side surface of the apparatus body 1*a* of the image forming apparatus 1. The double-side-printing transport path 61 includes a pair of sheet transport rollers 62 and transport guides 63 and 64 that transport the recording sheets 5 turned upside down to the pair of sheet transport rollers 51.

As illustrated in FIG. 1, the image forming apparatus 1 includes, on the front surface of the apparatus body 1*a*, the manual sheet feeder 70 to which a user manually feeds recording sheets 5. The manual sheet feeder 70 includes a manual feed tray 72 serving as an example of a manual sheet feeder exposed to the outside when a front cover 71 is opened. The recording sheets 5 placed on the manual feed tray 72 are separately fed one by one by a feeding device 73. The recording sheets 5 fed from the manual feed tray 72 are transported to the pair of sheet transport rollers 51 through the second sheet-feeding transport path 53 and a manual sheet-feeding transport path 77 including multiple pairs of sheet transport rollers 74 and multiple transport guides 75 and 76.

In FIG. 1, a controller 100 generally controls the operation of the image forming apparatus 1. The controller 100 includes a central processing unit (CPU), a read only memory (ROM), a random access memory (RAM), a bus connecting components including the CPU and ROM, and a communication interface, which are not illustrated.

Figure 2:
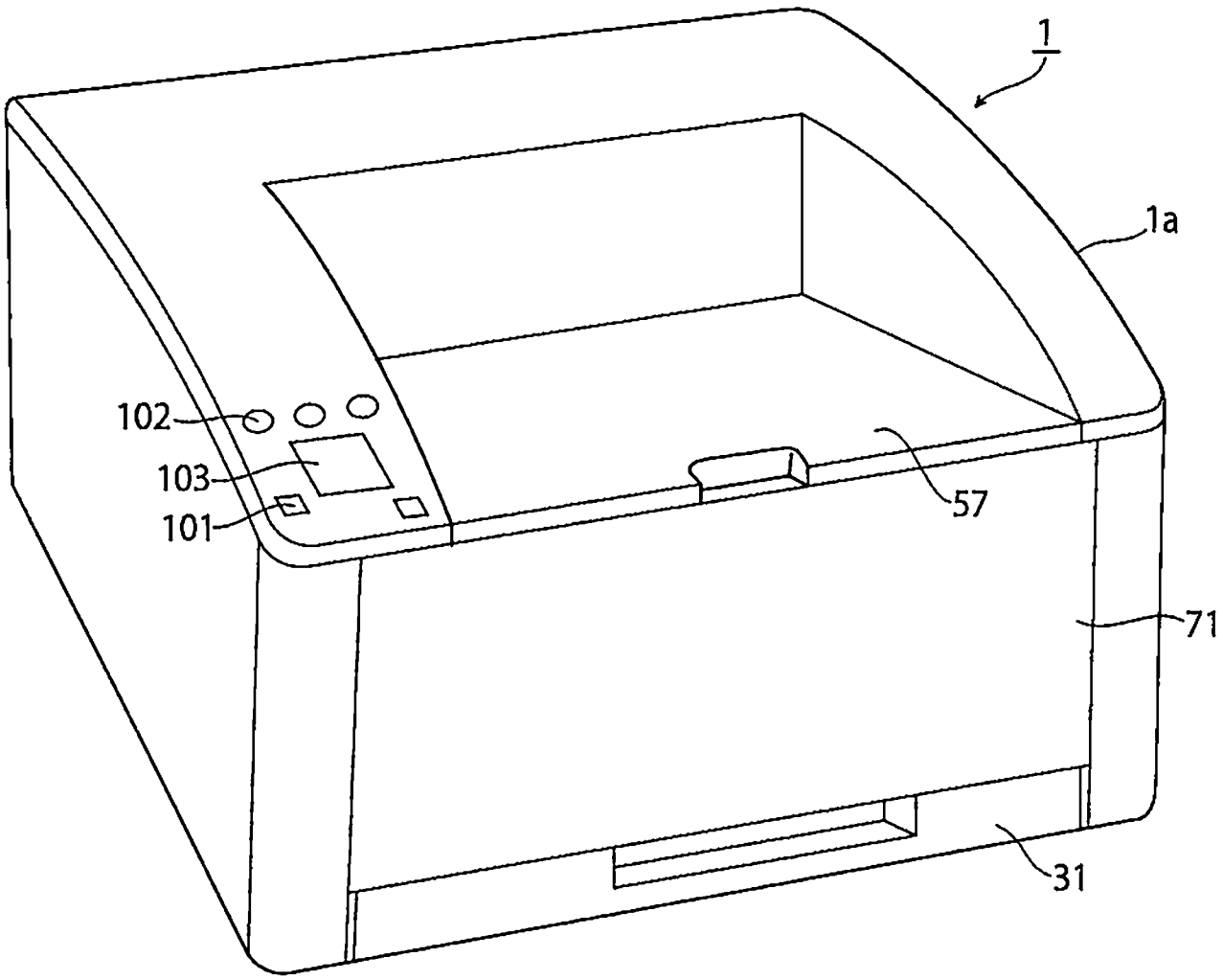
FIG. 2 is an external perspective view of an image forming apparatus in which the transport device according to the first exemplary embodiment of the present disclosure is included.

As illustrated in FIG. 2, operation buttons 101 and 102 are disposed to operate the image forming apparatus 1, and a display panel 103 displays the operation state of the image forming apparatus 1.

<Operations of Image Forming Apparatus>

Basic image forming operations performed by the image forming apparatus 1 will be described below.

Here, an operation of the four image forming devices 10 (10Y, 10M, 10C, and 10K) in a full-color mode for forming full-color images by combining toner images of four colors (Y, M, C, and K) will be described.

When the image forming apparatus 1 receives command information requesting a full-color image forming operation (print) through the operation buttons 101 and 102 or from, for example, a printer driver, not illustrated, the four image forming devices 10 (10Y, 10M, 10C, and 10K), the intermediate transfer device 20, the second transfer device 26, the fixing device 40, and other components are actuated.

As illustrated in FIG. 1, in each of the image forming devices 10 (10Y, 10M, 10C, and 10K), first, the photoconductor drum 11 rotates in a direction of arrow A, and the charging device 12 charges the surface of the photoconductor drum 11 with a predetermined polarity (negative polarity in the first exemplary embodiment) and potential. Subsequently, the exposing device 13 irradiates the charged surface of the photoconductor drum 11 with light based on an image signal obtained by converting image information input to the image forming apparatus 1 into each color component (Y, M, C, or K), to thus form, on the surface, an electrostatic latent image of each color component formed with a predetermined potential difference.

Subsequently, each of the image forming devices 10 (10Y, 10M, 10C, and 10K) performs development by feeding and electrostatically attaching, from the development roller 141, toner of the corresponding color (Y, M, C, or K) charged with a predetermined polarity (negative polarity) to the electrostatic latent image of the color component formed on the photoconductor drum 11. With this development, the electrostatic latent image of the color component on each photoconductor drum 11 is formed into a visible toner image of the corresponding one of the four colors (Y, M, C, and K) developed with the corresponding color toner.

Subsequently, when the toner images of the corresponding colors formed on the photoconductor drums 11 of the image forming devices 10 (10Y, 10M, 10C, and 10K) are transported to the first transfer positions, the first transfer devices 15 (15Y, 15M, 15C, and 15K) first-transfer the toner images of the corresponding colors to the intermediate transfer belt 21 rotating in the direction of arrow B of the intermediate transfer device 20 to be sequentially superposed one on another.

After each of the image forming devices 10 (10Y, 10M, 10C, and 10K) finishes first transfer, the drum cleaner 16 scratches accretions off to clean the surface of the photoconductor drum 11. Thus, the image forming devices 10 (10Y, 10M, 10C, and 10K) become ready for the next image forming operation.

Subsequently, the intermediate transfer device 20 carries the toner images first-transferred by the rotation of the intermediate transfer belt 21 to the second transfer position. Here, the sheet feeder 30 feeds a predetermined recording sheet 5 to the first sheet-feeding transport path 52 in accordance with the image forming operation. In the first sheet-feeding transport path 52, the pair of sheet transport rollers 51 serving as registration rollers feed the recording sheets 5 to the second transfer position at transfer timing.

At the second transfer position, the second transfer device 26 collectively second-transfers the toner images on the intermediate transfer belt 21 to the recording sheet 5. After the intermediate transfer device 20 has finished second transfer, the belt cleaner 27 removes accretions such as toner remaining on the surface of the intermediate transfer belt 21 subjected to second transfer to clean the intermediate transfer belt 21.

Subsequently, the recording sheet 5 to which the toner images are second-transferred is separated from the intermediate transfer belt 21, and then transported to the fixing device 40 through the sheet transport path 56. The fixing device 40 allows the recording sheet 5 subjected to second transfer to pass through a contact portion between the rotating heating rotator 41 and the rotating pressing rotator 42 to perform intended fixing processing (heating and pressing) to fix the unfixed toner images to the recording sheet 5. For an image forming operation for forming an image on only a single surface, the recording sheet 5 subjected to fixing is finally discharged by the pair of sheet-discharging rollers 58 to the discharged-sheet receiver 57 disposed at, for example, an upper portion of the apparatus body 1*a*.

Images are formed on both surfaces of the recording sheet 5 in the following manner. When the pair of sheet-discharging rollers 58 transport the recording sheet 5 having an image formed on one surface (first surface) to the discharged-sheet receiver 57, the rotation direction of the pair of sheet-discharging rollers 58 is switched to the reverse direction while the pair of sheet-discharging rollers 58 hold the trailing end of the recording sheet 5. The transport direction of the recording sheet 5 transported in a reverse direction by the pair of sheet-discharging rollers 58 is switched by the switch gate 60 toward the double-side-printing transport path 61. Thereafter, the recording sheet 5 is transported through the double-side-printing transport path 61 including the pair of sheet transport rollers 62 to the pair of sheet transport rollers 51 while being turned upside down. The pair of sheet transport rollers 51 feed the recording sheets 5 to the second transfer position in accordance with transfer timing. The toner images are second-transferred to the rear surface (second surface) of the recording sheet 5 from the intermediate transfer belt 21. The recording sheet 5 then undergoes a fixing process performed by the fixing device 40, and is discharged by the pair of sheet-discharging rollers 58 to the discharged-sheet receiver 57 disposed at an upper portion of the apparatus body 1*a* while having the second surface facing down.

With the above operations, a recording sheet 5 on which a full-color image formed by combining toner images of four colors is formed is output. When the image forming apparatus 1 forms monochrome images, only the black image forming device 10K is used to form monochrome images formed from toner images of black (K).

<Structure of Transport Device>

Figure 3:
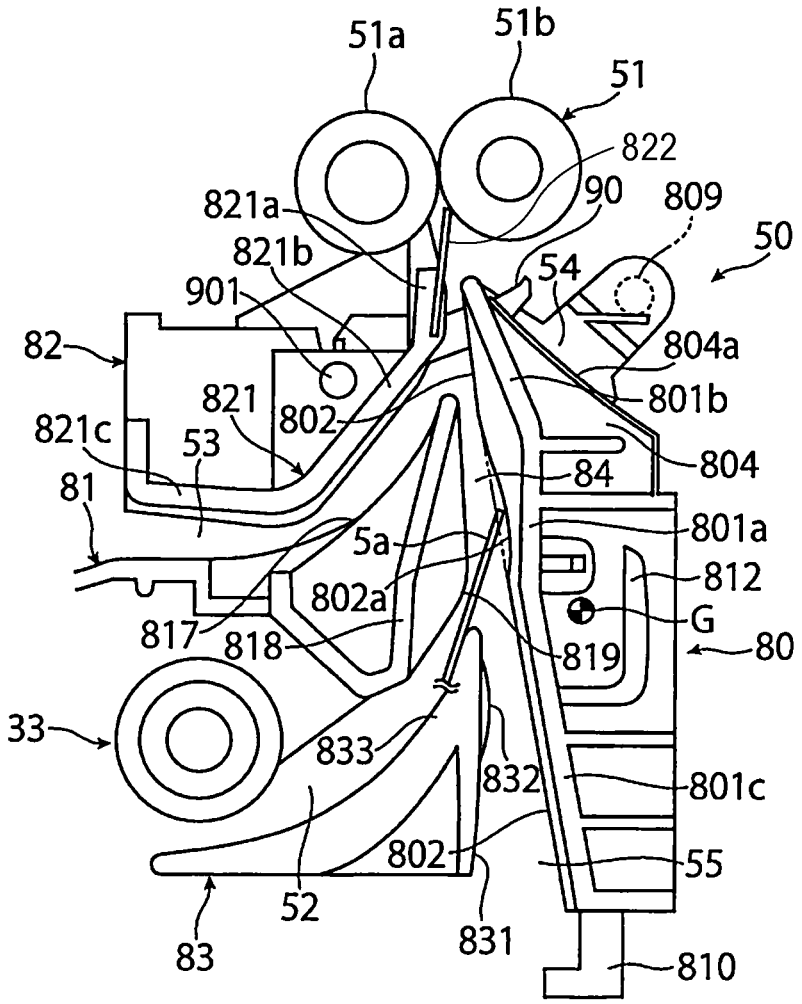
FIG. 3 is a cross-sectional view of the transport device according to the first exemplary embodiment of the present disclosure.

FIG. 3 is a cross-sectional view of a transport device of the image forming apparatus according to the first exemplary embodiment.

As illustrated in FIG. 1, the image forming apparatus 1 includes the transport device 50 that transports, to the second transfer position of the intermediate transfer belt 21 in synchronization with the toner images on the intermediate transfer belt 21, the recording sheets 5 fed from the sheet feeder 30, the recording sheets 5 fed from the manual sheet feeder 70, the recording sheets 5 transported through the double-side-printing transport path 61 while being turned upside down, or the recording sheets 5 fed from an auxiliary sheet feeder, not illustrated, disposed as an optional feeder at a lower portion of the apparatus body 1*a* of the image forming apparatus 1.

As illustrated in FIG. 3, the transport device 50 according to the first exemplary embodiment includes the pair of sheet transport rollers 51 and a first guide member 80. The pair of sheet transport rollers 51 are examples of a transport member that transports the recording sheet 5 while adjusting the leading end of the recording sheet 5. The first guide member 80 is disposed upstream from the pair of sheet transport rollers 51 in the transport direction of the pair of sheet transport rollers 51 to guide the recording sheets 5 to the pair of sheet transport rollers 51 along the transport path. The first guide member 80 is an example of a first guide member that is rotatable in a direction to open the transport path about its downstream end in the transport direction of the pair of sheet transport rollers 51.

In other words, the transport device 50 includes the pair of sheet transport rollers 51 and the first guide member 80. The pair of sheet transport rollers 51 transport the recording sheet 5 while adjusting the leading end of the recording sheet 5. The first guide member 80 is disposed upstream from the pair of sheet transport rollers 51 in the transport direction of the pair of sheet transport rollers 51 to guide the recording sheets 5 to the pair of sheet transport rollers 51 along the transport path. The end of the first guide member 80 opposite to the end closer to the pair of sheet transport rollers 51 moves to open the transport path.

As illustrated in FIG. 3, the pair of sheet transport rollers 51 include multiple driving rollers 51*a* arranged in the direction (width direction) crossing the transport direction of the recording sheet 5 and along the surface of the recording sheet 5, and driven rollers 51*b* pressed against the driving rollers 51*a*. The pair of sheet transport rollers 51 are stopped until the recording sheet 5 fed from the sheet container 31 by, for example, the feeding device 32 arrives thereon. The leading end of the recording sheet 5 fed from the sheet container 31 by, for example, the feeding device 32 hits against a nip portion between the stopped driving rollers 51*a* and driven rollers 51*b*. Thus, the leading end of the recording sheet 5 is bent after hitting against the nip portion between the stopped driving rollers 51*a* and driven rollers 51*b*, and the leading end of the recording sheet 5 has its inclination adjusted to be aligned with the nip portion between the driving rollers 51*a* and the driven rollers 51*b*. Thereafter, the driving rollers 51*a* of the pair of sheet transport rollers 51 are driven to rotate in synchronization with the toner images on the intermediate transfer belt 21. The recording sheet 5 is held between the driving rollers 51*a* and the driven rollers 51*b* and transported to the second transfer position of the intermediate transfer belt 21.

Figure 4:
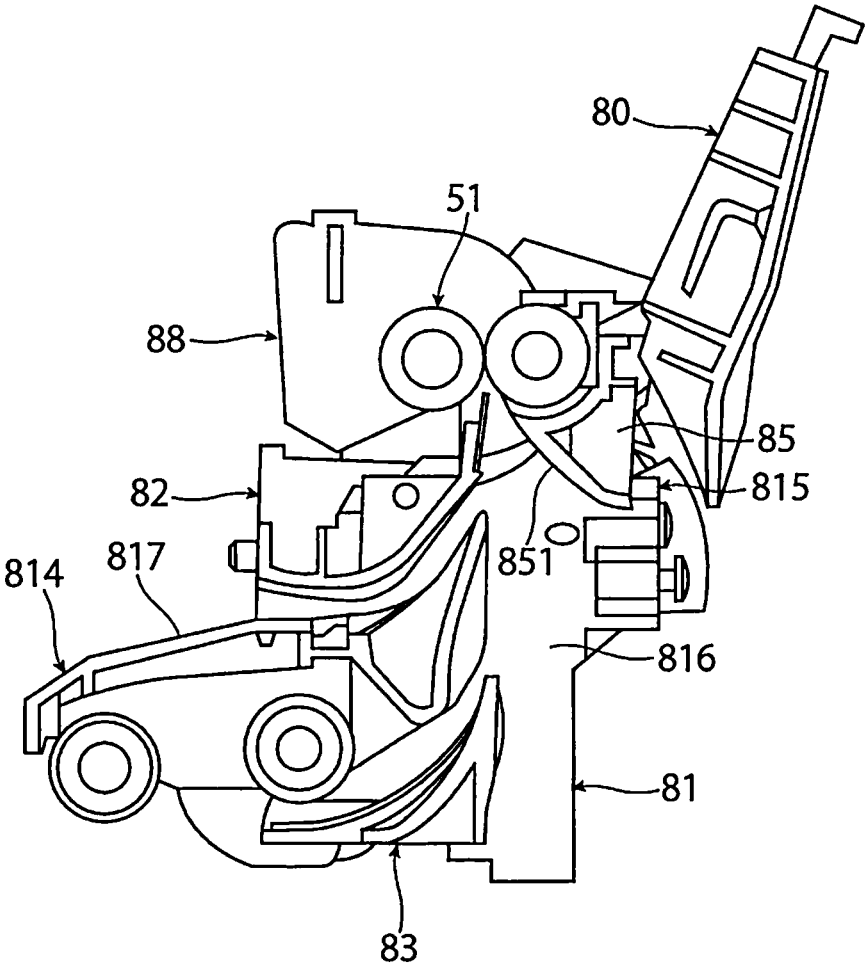
FIG. 4 is a cross-sectional view of the transport device according to the first exemplary embodiment of the present disclosure where a first guide member is in an open state.
Figure 5:
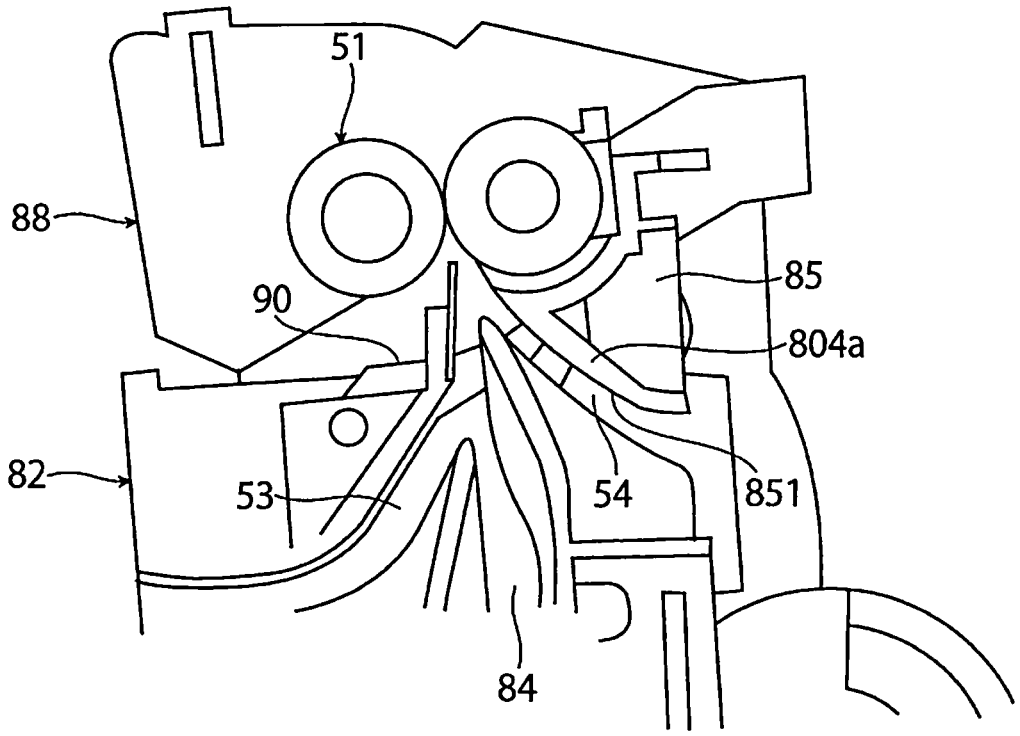
FIG. 5 is a cross-sectional view of the transport device according to the first exemplary embodiment of the present disclosure where the first guide member is in a closed state.

On the upstream side of the pair of sheet transport rollers 51 in the transport direction (lower side in the vertical direction in the drawing), a broad transport path 84 is defined to extend in the vertical direction by the first guide member 80 that guides the recording sheet 5 transported through the first to fourth sheet-feeding transport paths 52 to 55 serving as examples of transport paths to the nip portion of the pair of sheet transport rollers 51, and multiple guide members 81 to 83 opposing the first guide member 80. The broad transport path 84 is shared with the first, second, and fourth sheet-feeding transport paths 52, 53, and 55. As illustrated in FIGS. 4 and 5, the third sheet-feeding transport path 54 is defined by the first guide member 80 and a second guide member 85 serving as an example of a second guide member fixed near the pair of sheet transport rollers 51 to oppose an upper portion of the first guide member 80. The third sheet-feeding transport path 54, the second sheet-feeding transport path 53, and the first sheet-feeding transport path 52 are located in this order with increasing distance from the pair of sheet transport rollers 51.

Figure 6:
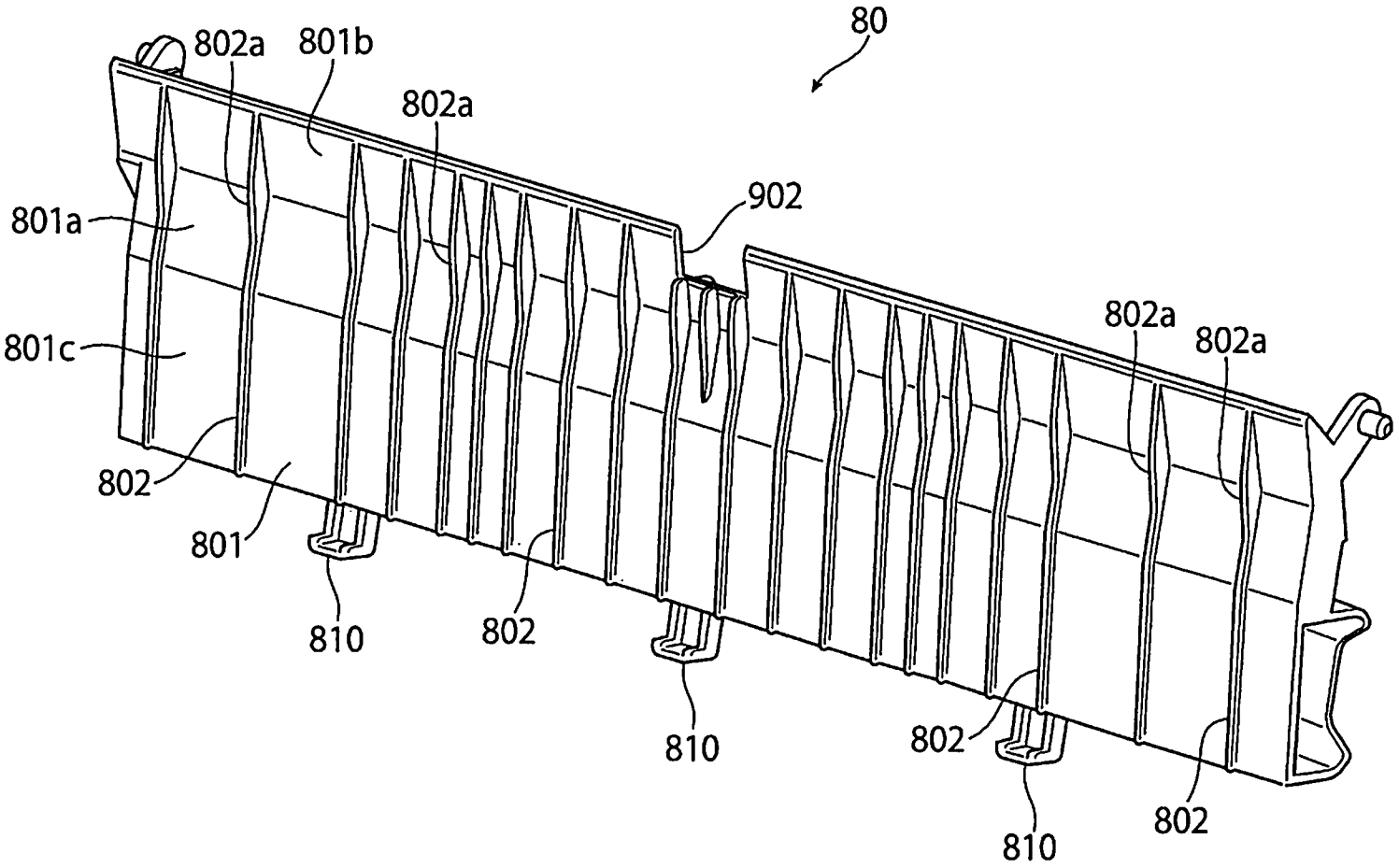
FIG. 6 is an external perspective view of a surface of the first guide member.

As illustrated in FIGS. 3 and 6, the first guide member 80 has a surface 801 formed in a flat plate that is thin in the horizontal direction with a substantially rectangular shape in a front view. The surface 801 faces the broad transport path 84. The surface 801 of the first guide member 80 includes a first guide plate 801*a*, a second guide plate 801*b*, and a third guide plate 801*c*. The first guide plate 801*a* is disposed on the upper side of the substantially middle in the vertical direction, and inclined toward the rear surface. The second guide plate 801*b* is continuous from the upper portion of the first guide plate 801*a*, and inclined toward the front surface. The third guide plate 801*c* is continuous from the lower portion of the first guide plate 801*a*, and has a lower end inclined toward the rear surface. Multiple ribs 802 that come into contact with the rear surface of the recording sheet 5 to guide the recording sheet 5 extend in the vertical direction on the first to third guide plates 801*a* to 801*c*. The multiple ribs 802 are spaced predetermined distances apart from each other in the width direction of the recording sheet 5 crossing the transport direction of the recording sheet 5. The recording sheet 5 is transported using the center in the width direction as a reference (so-called a center registration).

In the first exemplary embodiment, as illustrated in FIG. 3, the far ends of the multiple ribs 802 (far ends protruding toward the broad transport path 84) are not straight in the vertical direction drawn with a two-dot chain line, and the far ends of multiple ribs 802*a* on the first guide plate 801*a* are curved to be recessed toward the rear surface from the two-dot chain line. Thus, a leading end 5*a* of the recording sheet 5 transported along the first sheet-feeding transport path 52 comes into contact with the far ends of the multiple ribs 802*a* at a position upper in the vertical direction or closer to rotation supports 809, described later, of the first guide member 80 than in the case where the far ends of the multiple ribs 802 extend linearly. The moment of rotation that acts on the first guide member 80 to rotate in the counterclockwise direction in response to the leading end 5*a* of the recording sheet 5 coming into contact with the multiple ribs 802 is smaller than when the multiple ribs 802 extend straight as indicated with the two-dot chain line, since, in the present first exemplary embodiment, the leading end 5*a* of the recording sheet 5 comes into contact with the first guide member 80 at a position closer to the rotation supports 809 and with a shorter distance from the position to the rotation supports 809. Thus, also when the recording sheet 5 with relatively high stiffness such as a thick paper sheet is transported, the moment of rotation that the leading end 5*a* exerts on the first guide member 80 is relatively small, and is prevented from causing a positional shift of the first guide member 80.

In FIG. 3, a sheet sensor actuator 90 detects the leading end of the recording sheet 5. The sheet sensor actuator 90 is rotatable in the counterclockwise direction about a rotation axis 901 disposed at the fourth guide member 82. When the recording sheet 5 passes by the sheet sensor actuator 90, the sheet sensor actuator 90 is pushed by the leading end of the recording sheet 5 and rotates in the counterclockwise direction in the drawing to detect passage of the recording sheet 5. Output signals of the sheet sensor are input to the controller 100. As illustrated in FIG. 6, the first guide member 80 has a recess 902 that receives the sheet sensor actuator 90 at an upper end.

Figure 7:
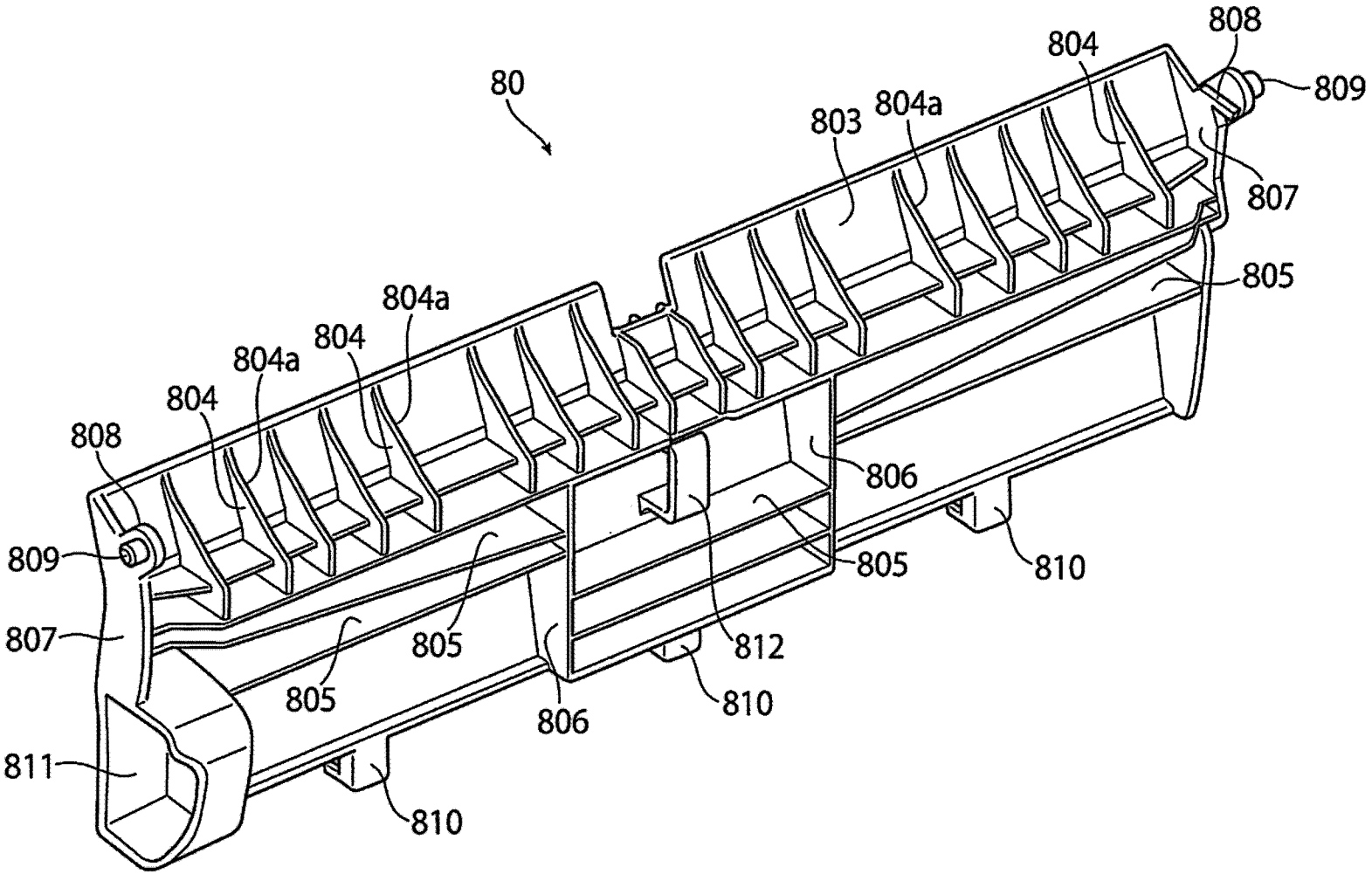
FIG. 7 is an external perspective view of a rear surface of the first guide member.

As illustrated in FIG. 3 and FIG. 7, multiple fourth guide plates 804 are arranged at an upper end portion of a rear surface 803 of the first guide member 80 at predetermined intervals in the longitudinal direction. Each fourth guide plate 804 has a substantially trapezoidal shape in a side view and forms a lower portion of the third sheet-feeding transport path 54. Each fourth guide plate 804 has an upper edge 804*a* curved downward with a predetermined radius of curvature into a recessed shape. As illustrated in FIG. 4, the third sheet-feeding transport path 54 is formed from a lower edge 851 of the second guide member 85 curved downward into a recessed shape, and the upper edges 804*a* of the fourth guide plates 804 in the first guide member 80.

An end portion 641 of the guide member 64 defining the double-side-printing transport path 61 disposed upstream from the third sheet-feeding transport path 54 is disposed above the upper edge 804*a* of the fourth guide plate 804 in the first guide member 80. This structure reliably prevents an occurrence of transport errors caused by, while being transported along the double-side-printing transport path 61, the recording sheet 5 formed from, for example, a thick paper sheet with relatively high stiffness pushing down the end portion 641 of the guide member 64 forming the double-side-printing transport path 61, and hitting against the side surface of the fourth guide plates 804 at the leading end of the recording sheet 5.

As illustrated in FIG. 7, multiple reinforcing ribs 805 and 806 for enhancing the stiffness of the first guide member 80 are integrally disposed on the rear surface 803 of the first guide member 80 in the horizontal direction and the vertical direction.

The first guide member 80 includes arms 808 that protrude obliquely upward from the rear surface at upper end portions of both side walls 807 disposed on both end portions in the longitudinal direction. Solid cylindrical rotation supports 809 protrude outward on the outer surfaces of the arms 808 at the far ends. The rotation supports 809 serve as examples of rotation support members that enable rotational attachment of the first guide member 80. As illustrated in FIG. 7, the rotation supports 809 of the first guide member 80 are rotatably supported by support holes 813 of support arms 812 serving as examples of rotation support members disposed on both end portions of the third guide member 81 in the longitudinal direction. The first guide member 80 and the support holes 813 of the support arms 812 serving as examples of the rotation support members oppose each other.

Figure 8:
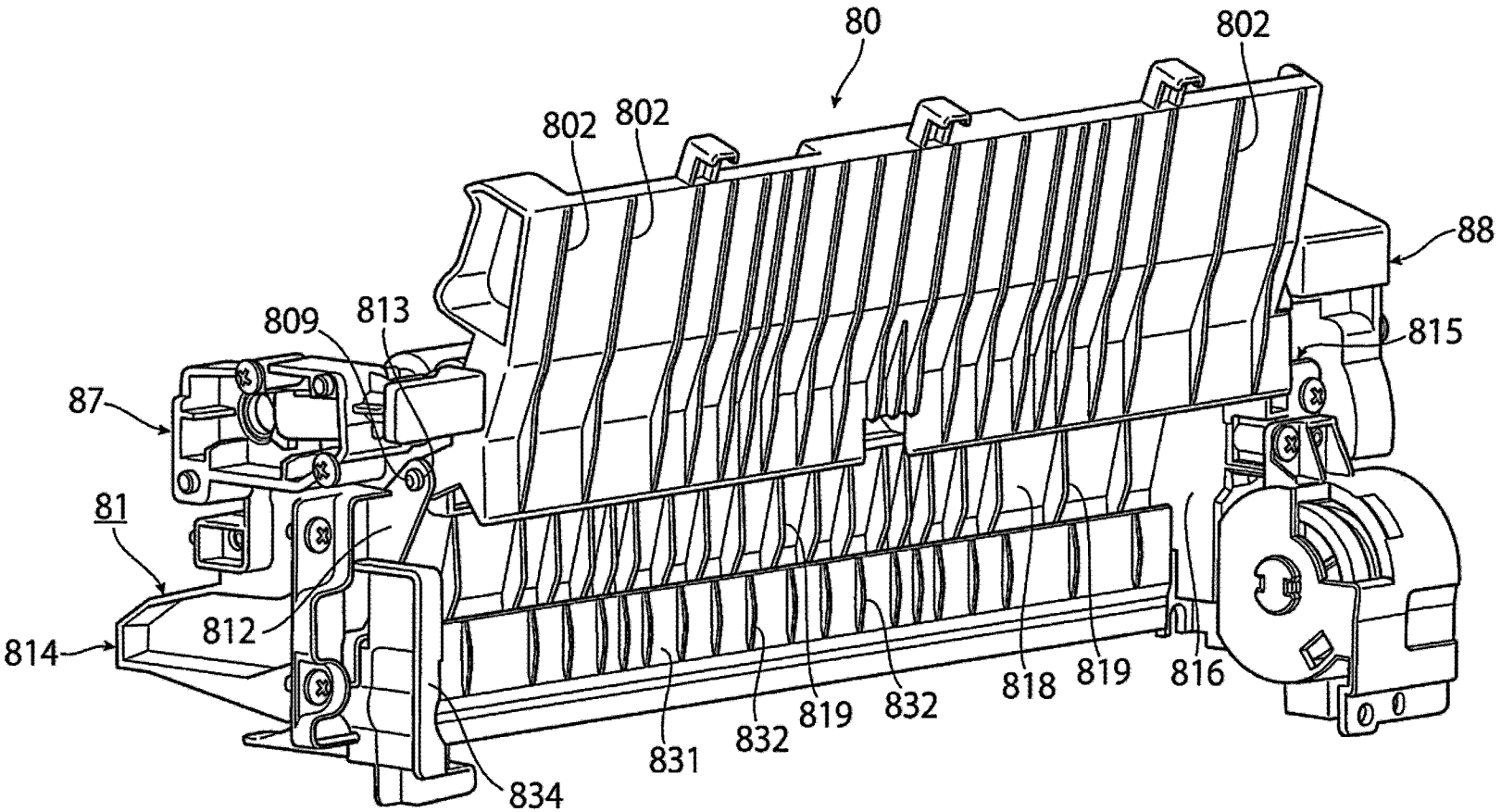
FIG. 8 is an external perspective view of the transport device according to the first exemplary embodiment of the present disclosure where the first guide member is in an open state.

As illustrated in FIG. 4 and FIG. 8, the first guide member 80 is capable of opening the entirety of the broad transport path 84 by rotating substantially 180 degrees in the counterclockwise direction about the rotation supports 809. In other words, the first guide member 80 moves about the rotation supports 809 while allowing an end portion opposite to the end portion (upper end portion) closer to the pair of sheet transport rollers 51, or in the illustrated example, a lower end portion in the vertical direction to open the broad transport path 84.

As illustrated in FIG. 1 and FIG. 6, at a lower end portion of the first guide member 80, positioning portions 810 are disposed at the center and both end portions in the longitudinal direction. The positioning portions 810 fix the first guide member 80 in an operation position by hitting against a frame member 1*b* serving as an example of a positioning portion formed from sheet metal and defining the fourth sheet-feeding transport path 55 of the apparatus body 1*a*. As illustrated in FIG. 7, a pull 811 is disposed at an end portion of the first guide member 80 in the longitudinal direction. The pull 811 is a recess on which a user hooks his/her fingers when opening or closing the first guide member 80 about the rotation supports 809.

Figure 9:
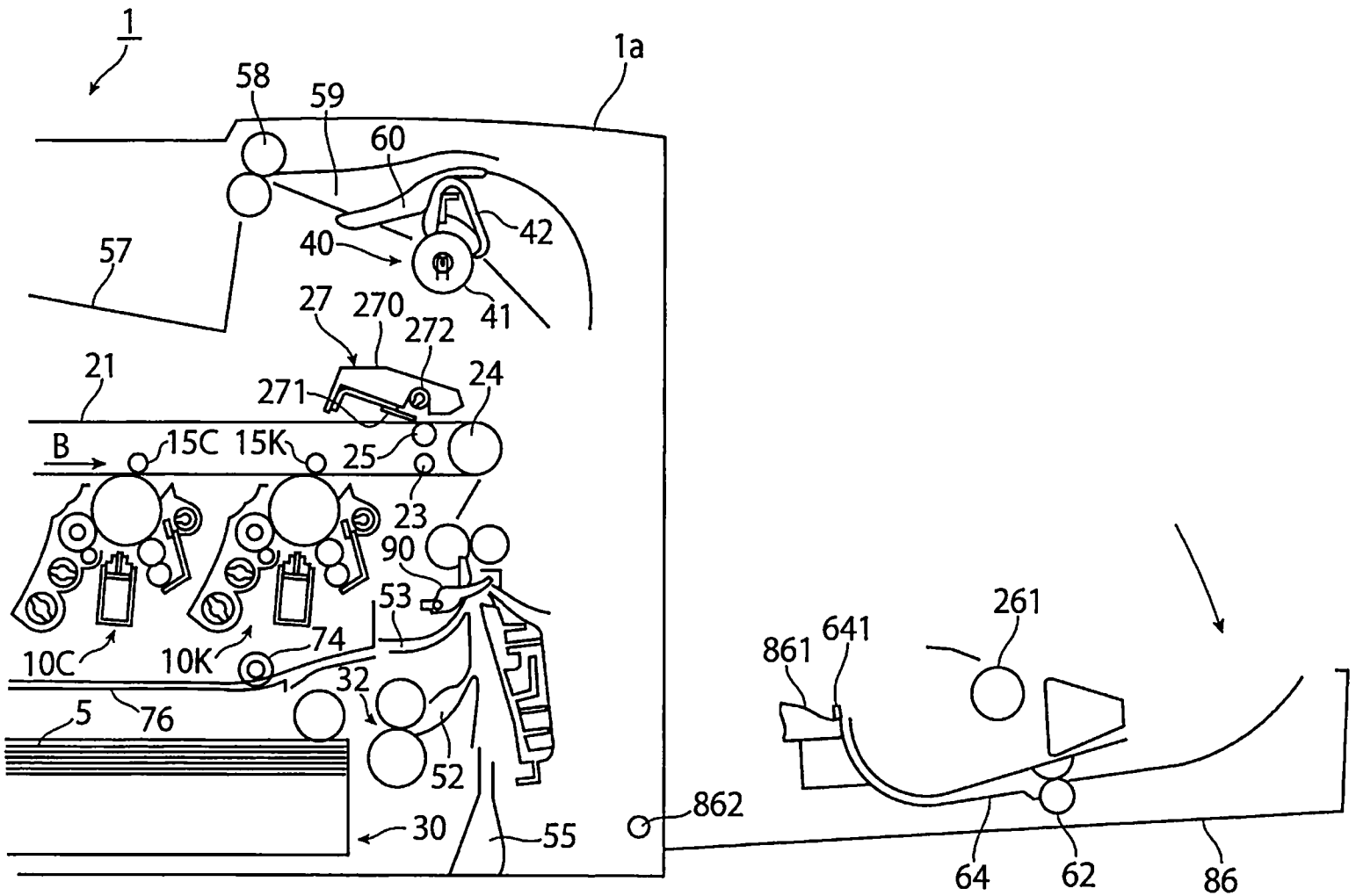
FIG. 9 is a cross-sectional view of an image forming apparatus according to the first exemplary embodiment of the present disclosure where a rear cover is in an open state.

As illustrated in FIG. 3 and FIG. 7, on the rear surface 803 of the first guide member 80, a leaf spring 812 is disposed in a cantilever manner at the center portion in the longitudinal direction. The leaf spring 812 exerts a pressing force to fix the first guide member 80 in the operation position. As illustrated in FIG. 9, a pressing portion 861 of a rear cover 86 comes into contact with the leaf spring 812 of the first guide member 80. The rear cover 86 is openably and closeably disposed on the rear surface of the apparatus body 1*a* of the image forming apparatus 1. The rear cover 86 is attached to the apparatus body 1*a* to be openable and closeable substantially 90 degrees about a rotation axis 862. As illustrated in FIG. 1, in the first guide member 80, when the rear cover 86 of the image forming apparatus 1 is closed, the leaf spring 812 is pressed by the pressing portion 861 of the rear cover 86 to rotate in a clockwise direction, and the positioning portions 810 at the lower end portion come into contact with the outer surface of the frame member 1*b* of the apparatus body 1*a* to be fixed in the operation position.

As illustrated in FIG. 3, the rotation supports 809 of the first guide member 80 are disposed at an upper end portion of the first guide member 80 in the vertical direction and one-sided toward the rear surface. Thus, the first guide member 80 has its center of gravity G one-sided toward the broad transport path 84 with respect to a perpendicular drawn in the vertical direction from the rotation supports 809. Thus, when the rear cover 86 of the image forming apparatus 1 is opened to remove the pressing force from the pressing portion 861, the first guide member 80 rotates with an effect of the moment of rotation for rotating in the counterclockwise direction in the drawing with its weight. As illustrated in FIG. 9, when a transportation error of the recording sheet 5 occurs, a user opens the rear cover 86 of the image forming apparatus 1 to visually check the first guide member 80 rotating in the direction to open the broad transport path 84, and thus finds that the first guide member 80 is rotatable in the counterclockwise direction.

As illustrated in FIG. 3, the third guide member 81 defining the first sheet-feeding transport path 52, the second sheet-feeding transport path 53, and the fourth sheet-feeding transport path 55 is disposed at a position opposing the first guide member 80 across the broad transport path 84.

As illustrated in FIG. 4 and FIG. 8, the third guide member 81 functions as a transport device body forming a large portion of the transport device 50. The third guide member 81 has a lower end portion 814 formed in a frame shape protruding toward the rear surface, and an upper end portion 815 protruding upward in a substantially rectangular parallelepiped frame shape. One end portion of the third guide member 81 in the longitudinal direction forms a side wall 816 protruding toward the broad transport path 84.

The third guide member 81 includes a feeding device container 817, which accommodates the feeding device 32 of the sheet feeder 30, on the rear surface of the lower end portion 814. As illustrated in FIG. 3, the third guide member 81 includes an opposing plate 818, defining the broad transport path 84 and the first sheet-feeding transport path 52, on the side surface opposing the first guide member 80. As illustrated in FIG. 8, the opposing plate 818 is a substantially rectangular thin flat plate extending in the longitudinal direction of the third guide member 81. Multiple ribs 819 that guide the surface of the recording sheet 5 extend in the vertical direction on the opposing plate 818 of the third guide member 81. The ribs 819 of the third guide member 81 oppose the ribs 802 of the first guide member 80 except for part of the lower end portion to form part of the broad transport path 84. The lower end portions of the ribs 819 of the third guide member 81 oppose an upper edge 833 of the fifth guide member 83 to define the leading end of the first sheet-feeding transport path 52.

The fourth guide member 82 is attached to the upper portion of the third guide member 81. As illustrated in FIG. 3, the fourth guide member 82 includes a path defining plate 821 including a far end portion 821*a*, an intermediate portion 821*b*, and a base end portion 821*c*. The far end portion 821*a* is a short flat plate opposing the upper edge of the first guide member 81. The intermediate portion 821*b* is inclined obliquely downward from the lower end portion of the far end portion 821*a*. The base end portion 821*c* extends in the horizontal direction from the lower end of the intermediate portion 821*b*. The second sheet-feeding transport path 53 is formed between the path defining plate 821 of the fourth guide member 82 and the upper edge 817 of the lower end portion 814 in the third guide member 81. At the far end portion 821*a* of the path defining plate 821, a guide plate 822 serving as a film member formed from, for example, a Mylar film to guide the recording sheet 5 to the nip portion between the pair of sheet transport rollers 51 is attached while being inclined at a small angle with respect to the vertical direction, or substantially vertically. Thus, the guide plate 822 formed from, for example, a Mylar film is capable of guiding the leading end of the recording sheet 5 transported from the third sheet-feeding transport path 54 curved at a relatively large angle with respect to the vertical direction to the nip portion between the pair of sheet transport rollers 51 without damaging the recording sheet 5 from collision.

More specifically, when the guide plate 822 formed from, for example, a Mylar film is disposed while being inclined by a large angle with respect to the vertical direction, the leading end of the recording sheet 5 transported from the third sheet-feeding transport path 54 curved at a relatively large angle with respect to the vertical direction is likely to collide against the guide plate 822 to be damaged.

As illustrated in FIG. 4 and FIG. 8, left and right support members 87 and 88 that rotatably support both end portions of the pair of sheet transport rollers 51 in the axial direction are attached at an upper portion of the fourth guide member 82.

The fifth guide member 83 is attached at the lower end portion of the third guide member 81 to oppose the broad transport path 84. The fifth guide member 83 has a cross section with a shape of a substantially right-angled triangle. A vertical plate 831 that faces the first guide member 80 to define the broad transport path 84 and the fourth sheet-feeding transport path 55 is disposed as the side surface of the fifth guide member 83. Multiple ribs 832 that guide the surface of the recording sheet 5 extend in the vertical direction on the surface of the vertical plate 831. The upper edge 833 of the third guide member 81 serves as a path defining portion curved downward into a convex to define the first sheet-feeding transport path 52 between itself and the third guide member 81. As illustrated in FIG. 8, a side wall 834 disposed to oppose the side wall 816 of the first guide member 81 is integrally disposed at one end portion of the fifth guide member 83 in the longitudinal direction.

<Operation of Transport Device>

Compared to the case where the rotation axis of the guide member that guides the recording medium to the transport member is disposed upstream in the direction of transporting a recording medium, the image forming apparatus 1 according to the first exemplary embodiment even including a smaller transport device is capable of preventing the guide member from interfering with the transport member in the following manner when the guide member rotates in the direction of opening the transport path.

Specifically, as illustrated in FIG. 1, in the image forming apparatus 1 according to the first exemplary embodiment, in response to an occurrence of a transportation error, such as a paper jam (or so-called a jam) of the recording sheet 5 fed from, for example, the sheet feeder 30 disposed upstream from the pair of sheet transport rollers 51 in the transport direction of the recording sheet 5, the sheet sensor actuator 90 detects the transportation error of the recording sheet 5.

When detecting the transportation error of the recording sheet 5, the controller 100 stops the image forming operation. When determining that the transportation error of the recording sheet 5 has occurred at the position upstream from the pair of sheet transport rollers 51 based on the signal from the sheet sensor, the controller 100 displays, on the display panel 103 or a printer driver, a message informing that a transportation error of the recording sheet 5 has occurred and prompting a user to open the rear cover 86.

As illustrated in FIG. 9, the rear cover 86 in the image forming apparatus 1 is opened by the user. When the rear cover 86 in the apparatus body 1*a* of the image forming apparatus 1 is opened by the user, the pressing portion 861 of the rear cover 86 stops pressing the leaf spring 812 of the first guide member 80. Thus, the first guide member 80 rotates even a slight angle in the counterclockwise direction with its weight, as illustrated in FIG. 9.

Thereafter, the user hooks his/her fingers on the pull 811 of the first guide member 80 to rotate the first guide member 80 about the rotation supports 809 in the counterclockwise direction. Thus, as illustrated in FIG. 4 and FIG. 8, the broad transport path 84 is exposed to the outside. The user then removes the recording sheet 5 that has caused the transportation error from the broad transport path 84 exposed to the outside, and rotates the first guide member 80 in the clockwise direction to return the first guide member 80 to the original position.

Thereafter, the user closes the rear cover 86 in the image forming apparatus 1. As illustrated in FIG. 1, when the rear cover 86 in the image forming apparatus 1 is closed, the pressing portion 861 of the rear cover 86 presses the leaf spring 812 of the first guide member 80, and the first guide member 80 is fixed in the operation position as a result of the positioning portion 810 of the first guide member 80 disposed at the lower end portion coming into contact with the frame member 1*b* of the apparatus body 1*a*.

In the first exemplary embodiment, the first guide member 80 is attached to be rotatable about the rotation supports 809 disposed at the upper end portion.

Figure 10:
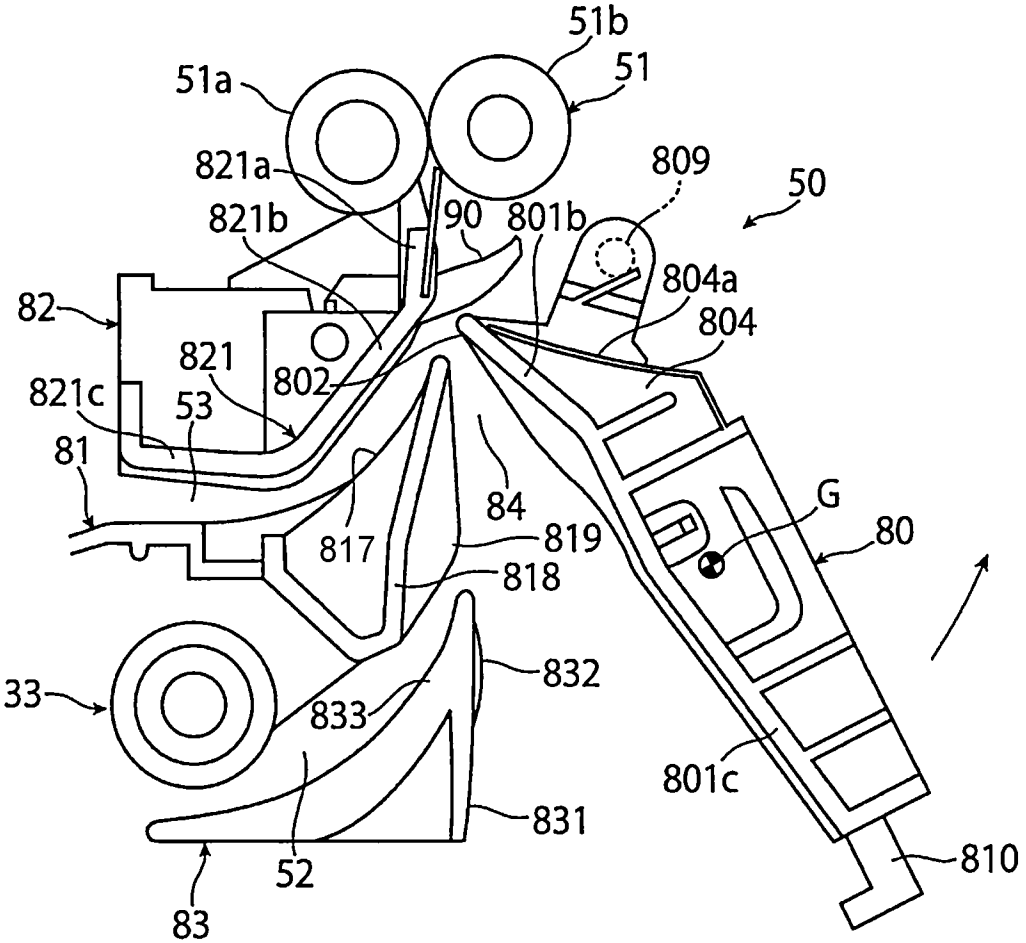
FIG. 10 is a is a cross-sectional view of the transport device according to the first exemplary embodiment of the present disclosure where the first guide member is in an open state.

Compared to an existing image forming apparatus where the first guide member 80 is attached to be rotatable about the rotation axis disposed at the lower end portion, as illustrated in FIG. 4 and FIG. 10, the first guide member 80 is prevented from interfering with, for example, the pair of sheet transport rollers 51 and the second guide member 85 disposed near the sheet transport rollers 51 even when the upper end portion of the first guide member 80 is disposed near the pair of sheet transport rollers 51 and the transport device 50 has a smaller size.

Figure 11:
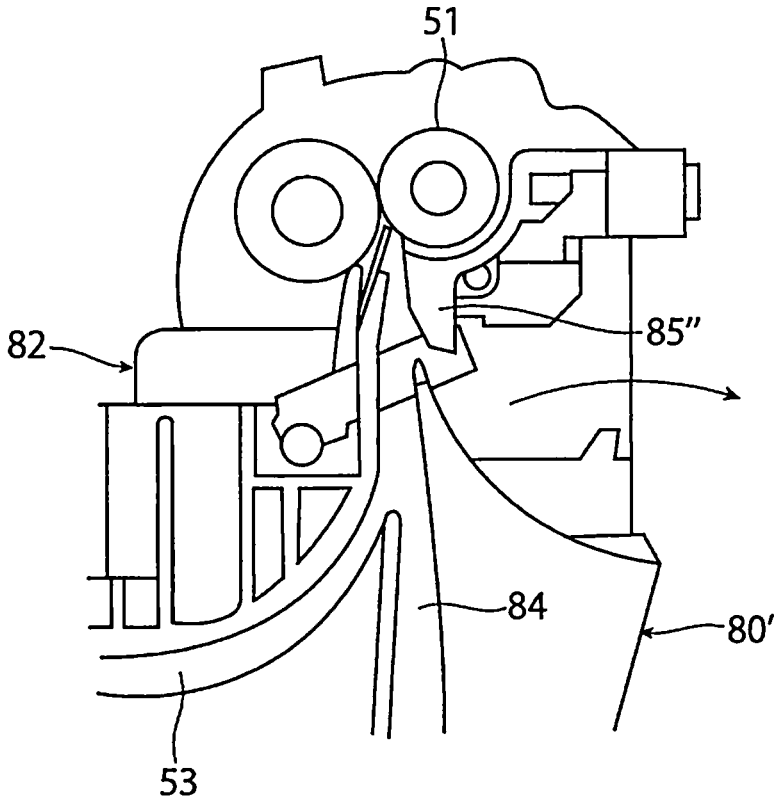
FIG. 11 is a cross-sectional view of a transport device of an existing image forming apparatus.

More specifically, as illustrated in FIG. 11, when, as in an existing image forming apparatus, a first guide member 80' is attached rotatably about a rotation axis, not illustrated, at the lower end portion of the first guide member 80', the first guide member 80' rotates about the rotation axis at the lower end portion. Thus, the upper end portion of the first guide member 80', that is, a portion near the pair of sheet transport rollers 51 moves along a large arc to open the broad transport path 84. To prevent the first guide member 80' from interfering with, for example, the pair of sheet transport rollers 51 and a second guide member 85" disposed near the pair of sheet transport rollers 51, a relatively large gap is to be left between the first guide member 80' and components such as the pair of sheet transport rollers 51 and the second guide member 85" disposed near the pair of sheet transport rollers 51. Thus, the transport device 50 and the image forming apparatus 1 have larger sizes.

On the other hand, as illustrated in FIGS. 4, 5, and 10, in the image forming apparatus 1 including the transport device 50 according to the first exemplary embodiment, the first guide member 80 is attached rotatably about the rotation supports 809 disposed at the upper end portions of the first guide member 80, that is, the end portions closer to the pair of sheet transport rollers 51. Thus, the first guide member 80 will suffice if it is rotatable about the rotation supports 809 disposed at the end portions closer to the pair of sheet transport rollers 51. When rotating, the first guide member 80 moves over a small area. This structure enables arrangement of the upper end portions of the first guide member 80 close to, for example, the pair of sheet transport rollers 51 and the second guide member 85 disposed near the pair of sheet transport rollers 51.

The image forming apparatus 1 according to the first exemplary embodiment thus does not involve a relatively large gap left between the first guide member 80 and components such as the pair of sheet transport rollers 51 and the second guide member 85 disposed near the pair of sheet transport rollers 51 to prevent the first guide member 80 from interfering with the pair of sheet transport rollers 51 and the second guide member 85 near the pair of sheet transport rollers 51. Thus, the transport device 50 and the image forming apparatus 1 may have smaller sizes.

In the above exemplary embodiment, a case where the image forming apparatus is applied to a full-color image forming apparatus has been described. However, this is not the only possible example, and the image forming apparatus is similarly applicable to a monochrome image forming apparatus.

In the exemplary embodiment, a case where the image forming apparatus is applied to an image forming apparatus that forms images with electrophotography has been described. However, this is not the only possible example, and the image forming apparatus is similarly applicable to an apparatus that forms images with inkjet or other methods.

In the above exemplary embodiments, size reduction of the image forming apparatus has been described. Although the present disclosure is particularly effective for a small-sized image forming apparatus, a small-sized image forming apparatus is not the requirement of application of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transport device, comprising:

a transport member that transports a recording medium while adjusting a leading end of the recording medium; and a guide member that is disposed upstream from the transport member in a transport direction of the transport member to guide the recording medium to the transport member along a transport path, the guide member being rotatable in a direction to open the transport path while having a downstream portion in the transport direction of the transport member serving as an axis, wherein the transport member has a first rotation axis around which it rotates, the guide member has a second rotation axis around which it rotates, and the second rotation axis is located outside a diameter of the transport member, and wherein the guide member extends in a vertical direction, is fixed in an operation position with a positioning portion at a lower end portion exerting a hitting force, and has a center of gravity located to exert a moment of rotation in a direction to open the transport path about the axis when the hitting force is released.

2. The transport device according to claim 1, wherein the axis of the guide member is located at a downstream end portion in the transport direction of the transport member, and spaced apart from the transport path than the center of gravity in a direction crossing the vertical direction and a surface of the recording medium.

3. The transport device according to claim 2, wherein a portion of the guide member that exerts the hitting force is spaced further from the axis than a portion of the guide member against which the recording medium transported along the transport path hits.

4. The transport device according to claim 1, wherein a portion of the guide member that exerts the hitting force is spaced further from the axis than a portion of the guide member against which the recording medium transported along the transport path hits.

5. The transport device according to claim 1, further comprising:

a second guide member disposed closer to the transport member than is the guide member to guide the recording medium to the transport member, wherein the guide member is disposed to partially overlap the second guide member in the transport direction of the recording medium.

6. The transport device according to claim 5, wherein the guide member moves in a direction away from the second guide member.

7. The transport device according to claim 1, further comprising a film member that guides the recording medium to a nip portion of the transport member.

8. The transport device according to claim 1, wherein the transport path includes:

a first transport path along which the recording medium is transported from a container that accommodates the recording medium;

a second transport path along which the recording medium is transported from a manual sheet feeder that feeds a recording medium fed manually; and a third transport path along which the recording medium is transported while being turned upside down.

9. The transport device according to claim 8, wherein the third transport path, the second transport path, and the first transport path of the transport path are located in order with increasing distance from the transport path.

10. The transport device according to claim 8, wherein the third transport path is disposed opposite to the first and second transport paths across the guide member.

11. An image forming apparatus, comprising:

an image forming member that forms images on a recording medium; and a transport device that transports the recording medium toward the image forming member, wherein the transport device according to claim 1 serves as the transport device.

12. A transport device, comprising:

a transport member that transports a recording medium while adjusting a leading end of the recording medium; and a guide member that is disposed upstream from the transport member in a transport direction of the transport member to guide the recording medium to the transport member along a transport path, the guide member moving to allow an end portion opposite to an end portion closer to the transport member to open the transport path, wherein the transport member has a first rotation axis around which it rotates, the guide member has a second rotation axis around which it rotates, and the second rotation axis is located outside a diameter of the transport member, and wherein the guide member extends in a vertical direction, is fixed in an operation position with a positioning portion at a lower end portion exerting a hitting force, and has a center of gravity located to exert a moment of rotation in a direction to open the transport path about the axis when the hitting force is released.

13. The transport device according to claim 12, wherein the axis of the guide member is located at a downstream end portion in the transport direction of the transport member, and spaced apart from the transport path than the center of gravity in a direction crossing the vertical direction and a surface of the recording medium.

14. The transport device according to claim 13, wherein a portion of the guide member that exerts the hitting force is spaced further from the axis than a portion of the guide member against which the recording medium transported along the transport path hits.

15. The transport device according to claim 12, wherein a portion of the guide member that exerts the hitting force is spaced further from the axis than a portion of the guide member against which the recording medium transported along the transport path hits.

16. The transport device according to claim 12, further comprising:

a second guide member disposed closer to the transport member than is the guide member to guide the recording medium to the transport member, wherein the guide member is disposed to partially overlap the second guide member in the transport direction of the recording medium.

17. A transport device, comprising:

a transport member that transports a recording medium to an image forming portion, and transports the recording medium subjected to printing by the image forming portion;

a guide member that is disposed upstream from the transport member in a transport direction of the transport member to guide the recording medium to the transport member along a transport path; and a rotation support member that is disposed downstream from the transport member in the transport direction of the transport member and supports the guide member to be rotatable in a direction in which the transport path is opened, wherein the guide member and the rotation support member oppose each other, the transport member has a first rotation axis around which it rotates, the guide member has a second rotation axis around which it rotates, and the second rotation axis is located outside a diameter of the transport member, and the guide member extends in a vertical direction, is fixed in an operation position with a positioning portion at a lower end portion exerting a hitting force, and has a center of gravity located to exert a moment of rotation in a direction to open the transport path about the axis when the hitting force is released.

18. The transport device according to claim 17, further comprising:

a second guide member disposed closer to the transport member than is the guide member to guide the recording medium to the transport member, wherein the guide member is disposed to partially overlap the second guide member in the transport direction of the recording medium.

* * * * *